United States Patent [19]

Liu

[11] Patent Number: 4,537,582

[45] Date of Patent: Aug. 27, 1985

[54] PLOTTER PAPER SLITTER

[75] Inventor: Dean-Yuan Liu, Canoga Park, Calif.

[73] Assignee: Sanders Associates, Inc., Nashua, N.H.

[21] Appl. No.: 538,864

[22] Filed: Oct. 4, 1983

[51] Int. Cl.[3] ..... B26D 3/08

[52] U.S. Cl. ..... 493/38; 83/DIG. 1; 83/425.2; 83/545; 83/563; 493/369

[58] Field of Search ..... 83/563, 564, 856, 425.1, 83/368, 545, DIG. 1, 425.2; 493/369, 38

[56] References Cited

U.S. PATENT DOCUMENTS

| | | | |
|---|---|---|---|
| 2,316,249 | 4/1943 | Johnson | 83/368 |
| 3,961,551 | 6/1976 | Doyel | 83/545 X |
| 4,094,217 | 6/1978 | Exline | 83/563 X |

*Primary Examiner*—James F. Coan

*Attorney, Agent, or Firm*—Louis Etlinger; William F. Porter, Jr.

[57] ABSTRACT

A slitting apparatus employing safety features and particularly suited for use in slitting strip paper as employed in a graphics drum plotter. A housing is provided which is adapted to be releasably attached to the frame of the plotter adjacent the takeup roller for the strip paper. The housing has a box-shaped top with a hinged opening rear portion. A plurality of knife blades are mounted in housings disposed in a slot in the wall of the box portion for adjustability as to their position along the width of the paper. The knife blades are spring-biased to a retracted position and adjustable actuators in the hinged portion extend the blades selectably only when the box is closed. A releasable latch is provided for holding the box in a closed position. A releasable latching assembly connects the housing to the frame of the plotter. The latching assembly is activated by opening the box which, in turn, retracts the knife blades. As thus configured, when the apparatus is removed from the plotter, the blades are automatically retracted to prevent operator contact and injury.

10 Claims, 12 Drawing Figures

PLOTTER PAPER SLITTER

BACKGROUND OF THE INVENTION

The present invention relates to cutting apparatus and, more particularly, to a removable and adjustable slitting apparatus for use in a graphic drum plotter, or the like, employing a strip media and having automatically retracted blades for safety purposes.

The description contained hereinafter is with respect to a graphic drum plotter employing strip paper. Those skilled in the art will recognize that the apparatus described herein has the potential for use in other strip media systems wherein a strip media is moved from a supply roller through a work area and onto a takeup roller wherein longitudinal slitting of the strip media is desired under safety conditions.

In co-pending patent application, Ser. No. 538,876 filed Oct. 4, 1983 entitled "MULTI-COLUMN PLOTTER" by Howard Brewer and William Lyons, also assigned to the common assignee of this application, a graphic drum plotter is described wherein the strip paper therein is divided into virtual columns with individual plots appearing in the columns. Therein it is suggested that following the drawing of the plots on the strip paper by the moving pen and prior to the strip paper being rolled onto the takeup roller, a slitter assembly be employed to slit the virtual columns at their point of juncture into actual strips of paper with one for each column. While it would be possible to simply mount a bar adjacent the takeup roller with knife blades mounted thereto, such an approach would be highly dangerous and highly impractical, particularly in view of such protective measures as the OSHA standards which apply to working environments.

Wherefore, it is the object of the present invention to provide a slitting apparatus for use in such applications which provides for safety protection of any exposed blades.

SUMMARY

The foregoing objective has been accomplished in a strip media system wherein a strip media is moved from a supply roller through a work area and onto a takeup roller mounted to a frame by the apparatus of the present invention for longitudinally slitting the strip media comprising: a housing adapted to be releasably attached to the frame and including a plate member having a surface in parallel spaced relationship to the strip media, the surface having an opening therethrough for the passage of a cutting blade; a cutter assembly retractably mounted to the plate member and having a cutting blade aligned with the slot, the cutter assembly being adapted to be moved between an extended position with the blade extending through the slot to contact the strip media to slit it and a retracted position with the blade retracted back through the slot and not being exposed on the surface where it is in a safety position protected from being contacted by a system operator; a latching mechanism having unlocked and locked positions for releasably securing the housing to the frame; and, safety actuator means connected between the latching mechanism and the cutter assembly for moving the cutter assembly to the extended position when the latching mechanism is in the locked position and for moving the cutter assembly to the retracted position when the latching mechanism is in the unlocked position whereby when the apparatus is removed from the system, the blade is automatically moved to the safety position.

In the preferred embodiment, a plurality of cutter assemblies are retractably mounted to the wall member and the cutter assemblies are individually adjustable as to their position with respect to the strip media. Additionally, the safety actuator means are selectably connectable to respective ones of the cutter assemblies whereby only selective ones of the blades are moved to the extended position when the latching mechanism is in the locked position.

DESCRIPTION OF THE PREFERRED AND ALTERNATE EMBODIMENTS

Figure 1:
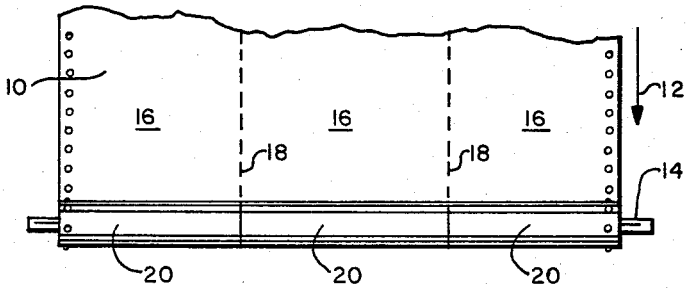
FIG. 1 is a simplified drawing of a strip media adjacent a takeup roller as wherein the present invention is employed.
Figure 2:
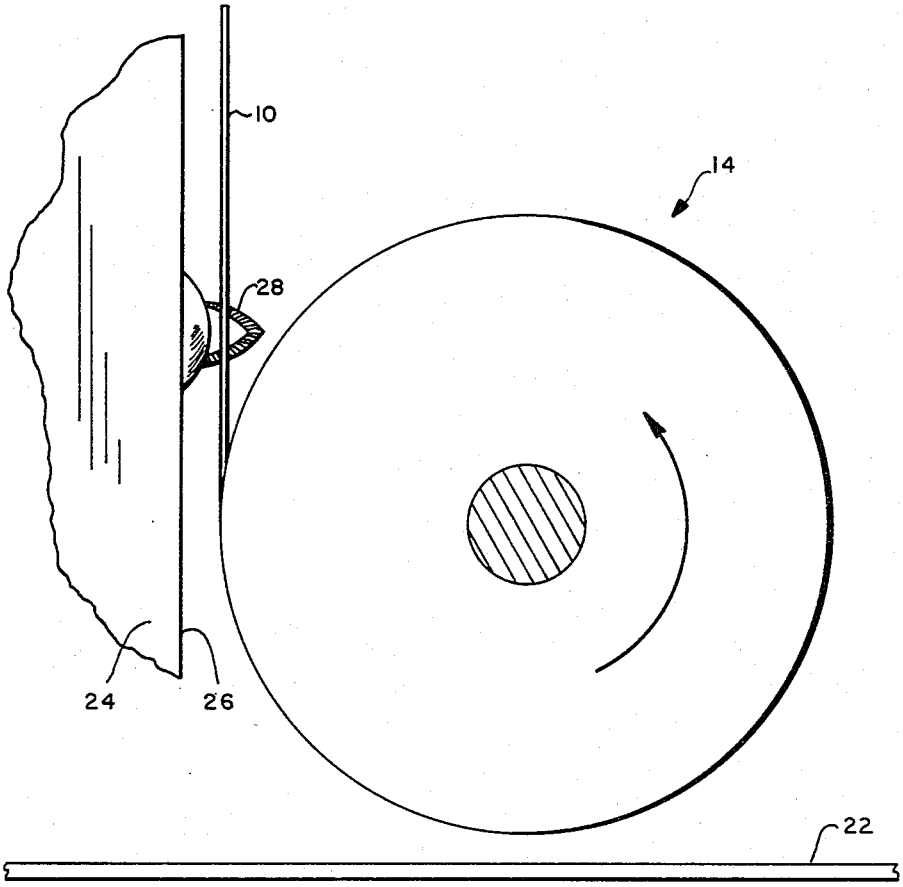
FIG. 2 is a simplified drawing of a side view of strip media moving onto a takeup roller showing a blade slitting the strip media.

Turning first to FIG. 1, the environment as wherein the present invention is particularly adapted for use is shown in simplified form. A strip media, such as strip paper 10, moving in the direction of arrow 12 is wound onto takeup roller 14. The paper 10 comprises three virtual columns 16 as defined by the dotted dividing lines 18. Before being wound onto the roller 14, it is desired to slit the paper 10 along the dotted lines 18 to form three actual strips 20 on the takeup roller 14 corresponding to the virtual columns 16. As shown in FIG. 2, the roller 14 is typically mounted adjacent a portion of the frame 22 of a plotter. A mounting member 24 can be attached to the frame 22 having a plate member with a front surface 26 adjacent the paper 10 and with blades 28 attached thereto in alignment with the cutting lines 18 and extending through the paper 10 to cut it. As previously discussed, however, such an arrangement could be inherently unsafe.

Figure 3:
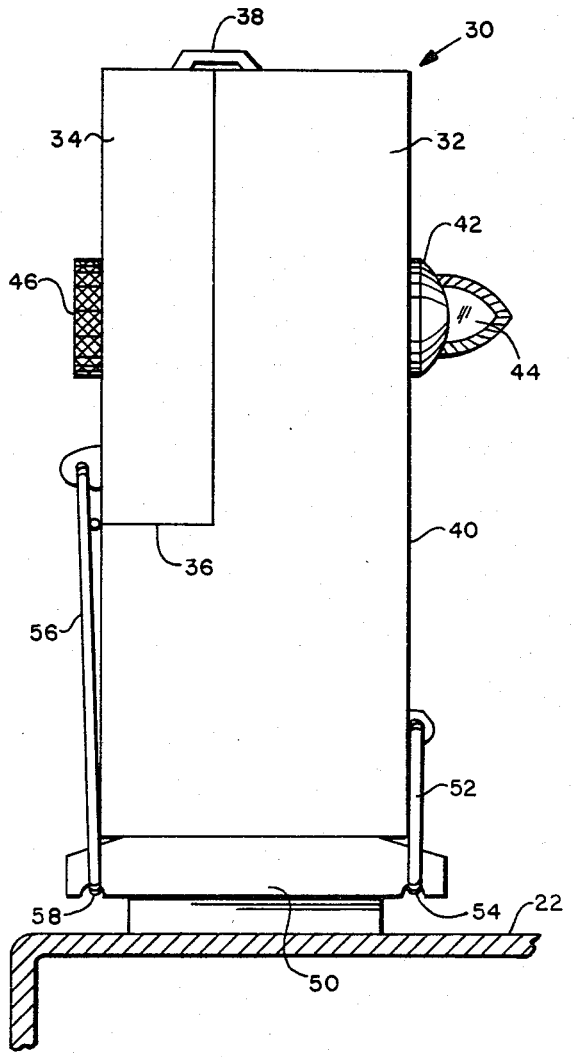
FIG. 3 is a simplified version of the slitting apparatus of the present invention according to one embodiment with the apparatus attached and the blade extended.
Figure 4:
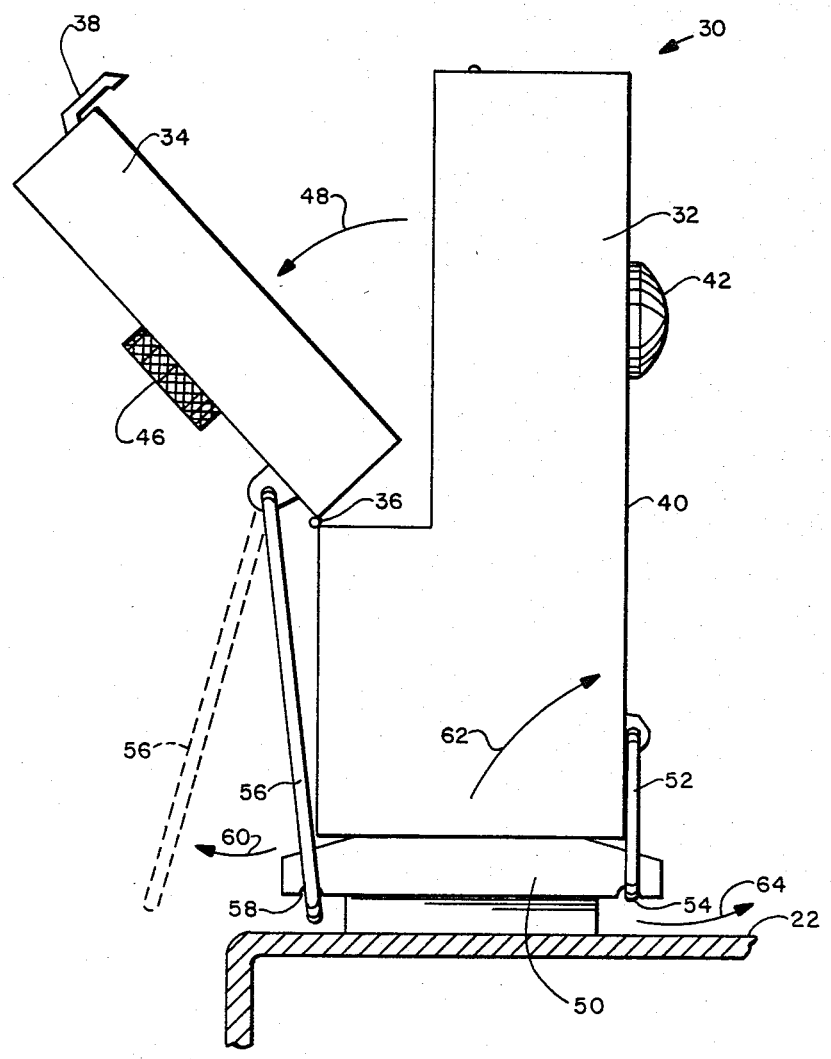
FIG. 4 shows the apparatus of FIG. 4 being released for removal and with the blade retracted.

Turning now to FIGS. 3 and 4, the principles of the present invention are shown in a generalized form according to one embodiment which could be employed for general purpose applications. The cutting apparatus, generally indicated as 30, comprises a closed box 32 having an opening portion 34 hinged at 36 and with a releasable latch 38 for releasably holding the opening portion 34 closed to the rest of the box 32. The box 32 has a plate member with a front wall 40 having a cutter assembly 42 mounted therein and with a spring biased retractable blade 44 therein. A blade actuator 46 is carried by the opening portion 34. When the opening portion 34 is in the closed and locked position as shown in FIG. 3, the blade actuator 46 causes the retractable blade 44 to be extended as shown in FIG. 3. When the opening portion 34 is unlocked and opened in the direction of arrow 48 as shown in FIG. 4, the blade actuator 46 is moved away from its contact with the cutter assembly 42 and, as a consequence, the retractable blade 44 is automatically retracted into the cutter assembly 42.

To further accomplish the safety objectives of the present invention, the box 34 is mounted to the frame 22 on mounting block 50. A first latching loop 52 holds the front of the box 32 to the mounting block 50 by passing thereunder and into a first notch 54. A second latching loop is connected to the opening portion 34 and passes under the mounting block 50 adjacent a second notch 58. With the second latching loop 56 adjacent the second notch 58 and with the opening portion 34 in the closed position of FIG. 3, the retractable blade 44 is extended and, additionally, the box 34 cannot be removed from the mounting block 50 because the second latching loop 56 is pulled up into the second notch 58 holding the box 32 tightly against the mounting block 50. To release the box 32, the opening portion 34 must be unlocked and opened in the direction of arrow 48, which causes the second latching loop 56 to be dropped out of the second notch 58. It can then be rotated in the direction of arrow 60 towards the ghosted position as shown whereupon the box 32 can be rotated in the direction of arrow 62, which then causes the first latching loop 52 to be dropped out of the first notch 54 whereupon it can be rotated in the direction of arrow 64 and the entire box 32 then be removed.

Figure 5:
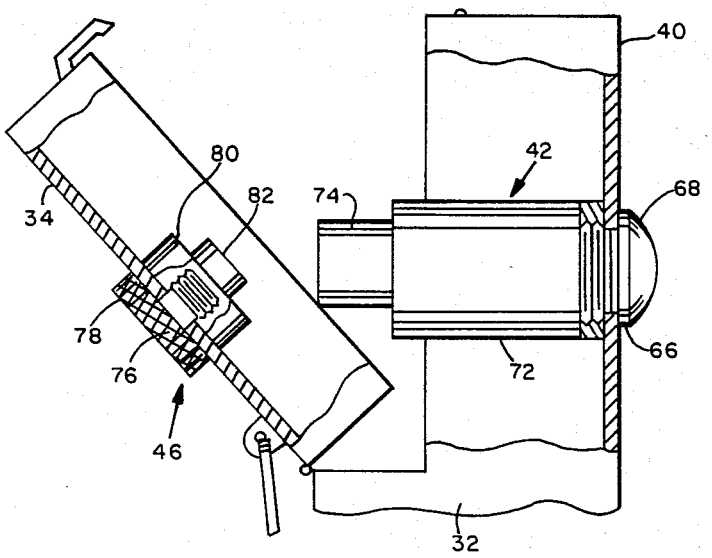
FIG. 5 is a cutaway view through a portion of the apparatus of FIG. 4 showing the method of retracting the blade.
Figure 6:
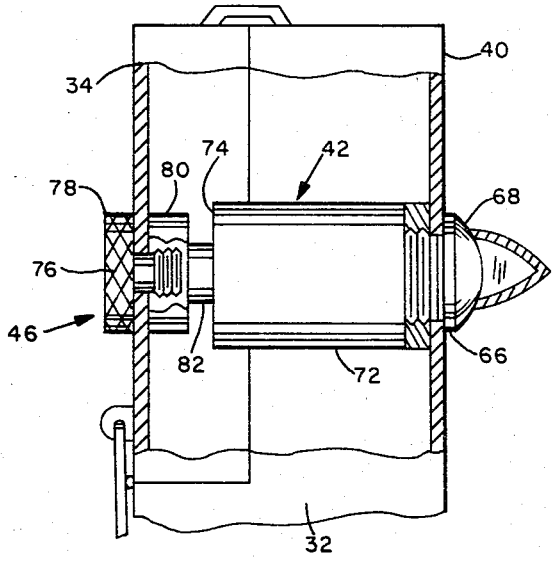
FIG. 6 is a cutaway view through the apparatus of FIG. 3 showing the manner of extending the cutting blade.
Figure 7:
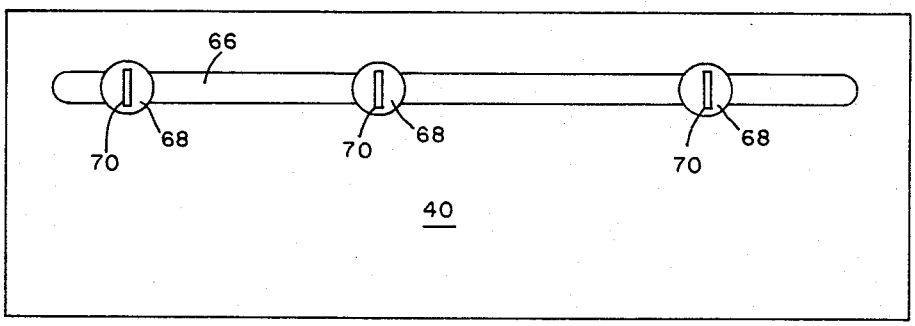
FIG. 7 is a view of the housing surface, i.e., the plate member containing the cutting blade holding members showing the slot containing them and thus providing the adjustability.

Turning now to FIGS. 5–7, the method of operation of the cutter assembly 42 is shown in greater detail. The cutter assemblies 42 are mounted in a slot 66 in the front wall 40 of the box 32. Each cutter assembly 42 comprises an outer portion 68 containing a slot 70 through which the retractable blade 44 can pass. The outer portion 68 is threaded into an inner portion 72 containing a plunger 74 connected to the retractable blade 44. By releasing the threaded connection between the outer portion 68 and inner portion 72, each cutter assembly 42 can be slid along the slot 66 to set its position. There is one blade actuator 46 for each cutter assembly 42. The blade actuators 46 are mounted in a slot 76 in the opening portion 34 which is aligned with the slot 66. Each blade actuator 46 contains an outer portion 78 threaded into an inner portion 80 having a projection 82 thereon. As can be seen in FIG. 6, when the opening portion 34 is closed, the projection 82 contacts the plunger 74 and pushes it into the inner portion 72 thus extending the retractable blade 44 connected thereto. If one or more blades 44 are not to be used, its cutter assembly 42 and associated actuator 46 are misaligned, such that the blade 44 is not extended when the opening portion 34 is closed.

Figure 9:
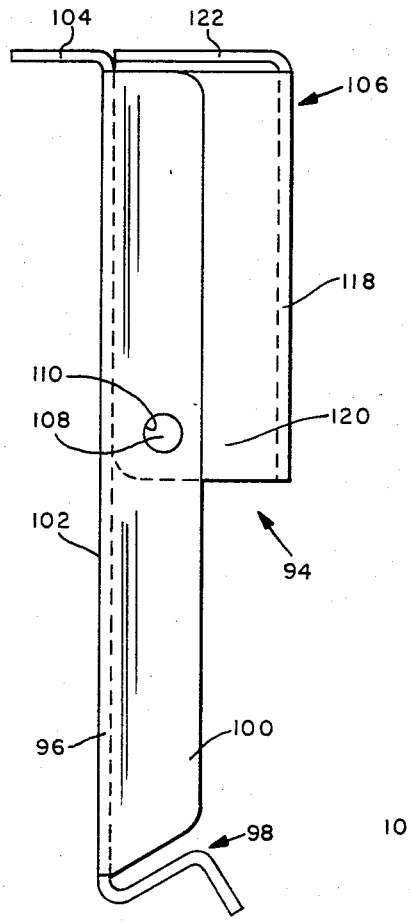
FIG. 9 is a side view of the housing portion of the present invention in its preferred embodiment.
Figure 10:
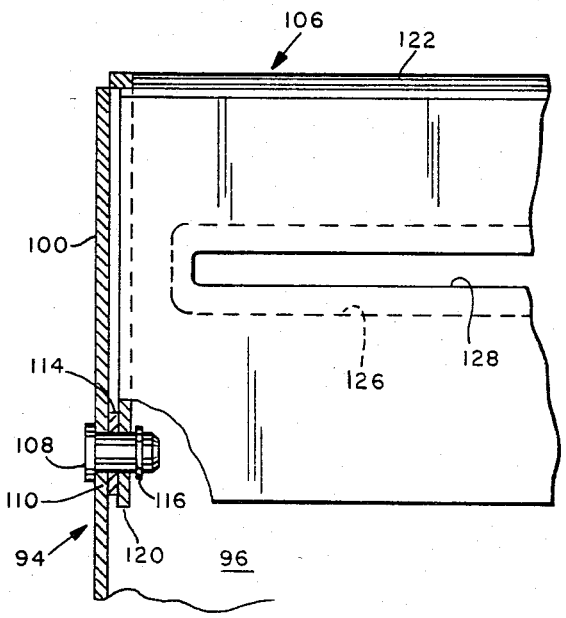
FIG. 10 is a partially cutaway view showing the attachment of the hinged cover portion in the preferred embodiment of the present invention.
Figure 11:
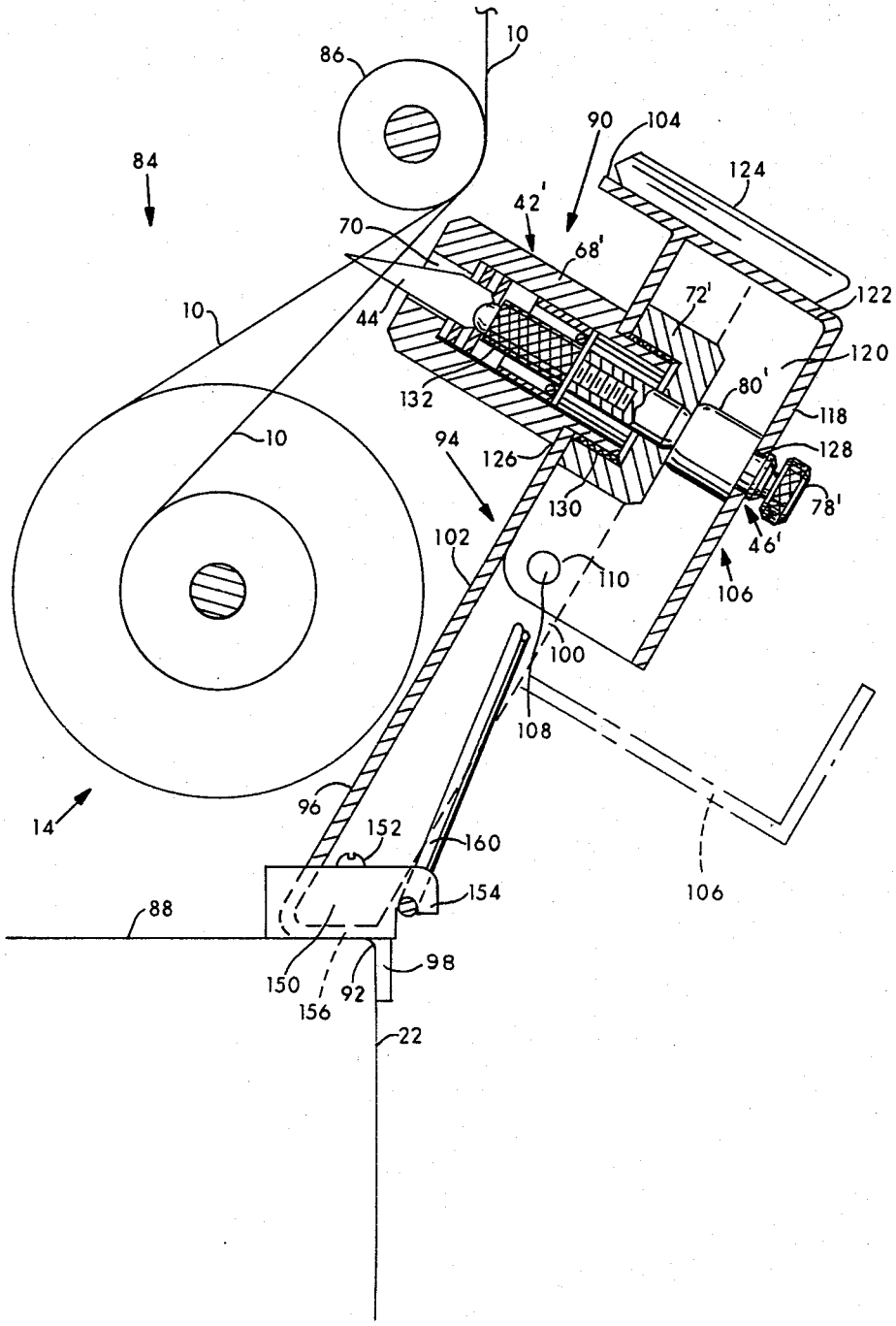
FIG. 11 is a cutaway side view through the cutter assembly of the present invention in its preferred embodiment.

Turning now to FIGS. 8–12, the present invention is shown in its preferred embodiment as employed as part of a commercial printer/plotter manufactured by the assignee of this application. As shown in FIG. 11, the plotter, generally indicated as 84, moves strip paper 10 down from a supply roller (not shown) through a work area (not shown) across idler roller 86, and onto takeup roller 14. In FIG. 11, takeup roller 14 is shown with both a small amount of paper 10 wrapped thereon and with a larger amount wrapped thereon to show the increasing diameter thereof and the changing angle of the paper 10 as it leaves the idler roller 86. The takeup roller 14 is positioned close adjacent the top surface 88 of the bottom portion of the plotter's frame 22. The cutting apparatus of the present invention according to this preferred embodiment, generally indicated as 90, is designed to releasably clamp to the edge 92 of the top surface 88 in a manner to be more fully described shortly so as to require a minimum of modification to the plotter 84 in order to add the cutting apparatus 90 of the present invention. As can be seen, the cutting apparatus 90 of the present invention in this preferred embodiment is designed to angle back outwardly from the edge 92 so as to clear the paper 10 on the takeup roller 14 in its normal range of sizes and to project the cutter assembly 42 forward into the space between the takeup roller 14 and the idler roller 86 so as to cause the cutting or slitting action to take place at a point close adjacent the idler roller 86 such that the blade 44 passes through the paper 10 regardless of the angle between the idler roller 86 and the takeup roller 14 as can be seen in FIG. 11. The cutting blades are also put into positions of safety as will be more fully described shortly.

Figure 8:
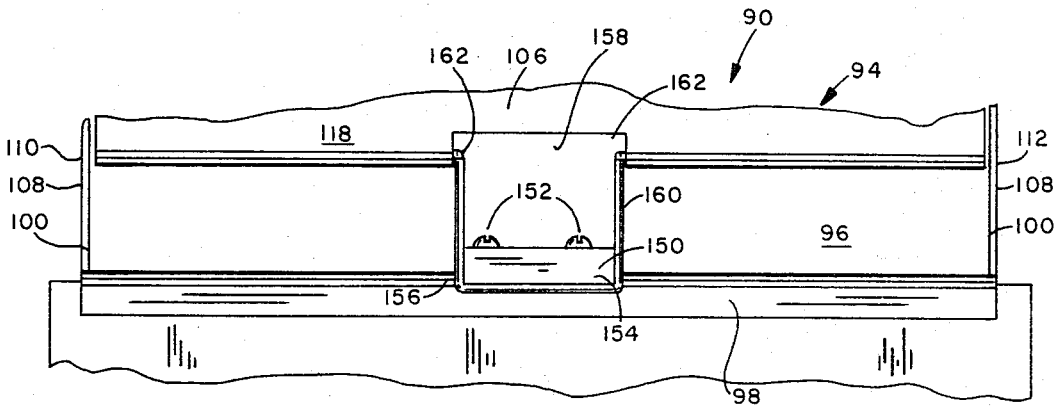
FIG. 8 is an elevation drawing of the latching assembly employed to hold the preferred embodiment of the present invention as employed in a graphic plotter onto the frame of the plotter.

The support and housing assembly 94 of cutting apparatus 90 can best be understood with reference to FIGS. 8–10. Support and housing assembly 94 comprises a vertical plate member 96 having an angled lip 98 along the bottom edge thereof adapted to curve around the edge 92 of the frame 22. A pair of side members 100 are bent backwards away from the front surface 102 at 90° thereto. A top member 104 is angled forward over the front surface 102 at 90° thereto. A hinged cover, generally indicated as 106, is attached to the top portion of the support and housing assembly 94 by pivot pins 108 passing through holes 110 and 112 with a spacer washer 114 disposed therebetween and with a spring retaining clip 116 to hold it removably in place. The hinged cover 106 comprises a back plate 118 having a pair of side members 120 bent forward at 90° thereto and a top member 122 also bent forward at 90° thereto such that when in the closed position as shown in FIG. 9, the hinged cover 106 in combination with the front surface 102 of the vertical plate 96 defines a housing in the manner of the closed box 32 of the more general embodiment described earlier herein. A releasable latch 124 is provided to hold the hinged cover 106 in its closed position as shown in FIGS. 9 and 11. When the latch 124 is released, the hinged cover 106 can be rotated to the ghosted position of FIG. 11 to give access thereto for adjusting the position of the cutting apparatus 90.

As with the previously described embodiment, the cutting apparatus 90 comprises a cutter assembly 42' which is mounted in a slot 126 provided therefor in the vertical plate member 96 and a blade actuator 46' which is mounted in a slot 128 provided therefor in the back plate 118 of the hinged cover 106. The cutter assembly 42', as with the previously described embodiment, comprises an outer portion 68' threaded at 130 into an inner portion 72' as best seen in FIG. 11. In this embodiment, the outer portion 68' is extended so as to have the opening of the slot 70 close adjacent the idler roller 86. By being so configured, the blade 44 in its extended position as shown in FIG. 11 is safely protected from operator contact by the close spacing between the outer portion 68' and the idler roller 86. The blade actuator 46' comprises an outer portion 78' which is threaded into an inner portion 80' which is extended in length so as to incorporate the function of the projection 82 in the previously described embodiment.

Figure 12:
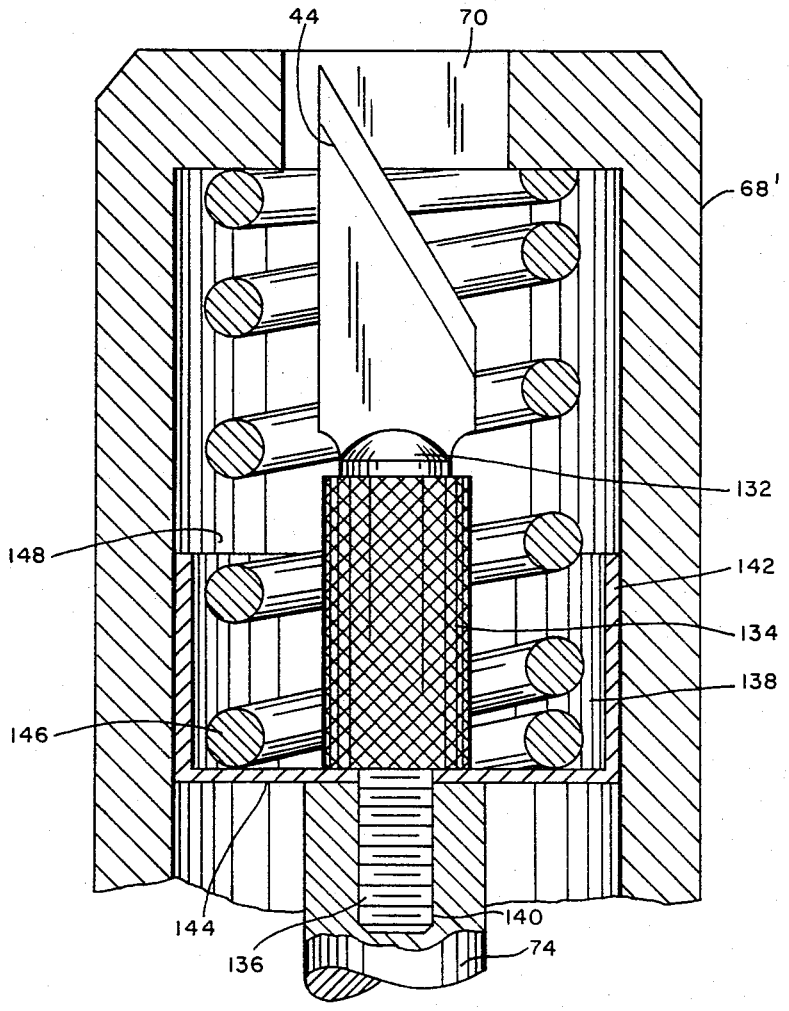
FIG. 12 is an enlarged, cutaway drawing showing the construction of the cutter assembly.

The method of operation of the cutter assembly 42' can best be understood with primary reference to FIG. 12. The outer portion 68' is a hollow cylinder with a closed outer end having the slot 70 therein. The retractable blade 44, as well as the gripping jaw member 132 and knurled collar 134, are taken from a commercial modeler'knife of the type sold under the tradename "X-acto". The handle from the modeler's knife is replaced by the plunger 74 which has a threaded bore 136 in the end thereof. A guide cup 138 is placed over the threaded shank 140 of the gripping jaw member 132 before it is threaded into the plunger 74. The guide cup 138 serves two purposes. The extended sidewalls 142 thereof are sized to be a slide fit within the inner walls of the cylindrical outer portion 68' thereby guiding the blade 44 and its connecting elements smoothly in and out of the slot 70. As a second function, the rear surface 144 of the guide cup 138 acts as one point of abutment for a coil spring 146 disposed between it and the inner wall 148 of the closed end of the outer portion 68'. As thus positioned, the spring 146 tends to bias the retractable blade 44 towards its retracted position and it can only be extended by the force of the inner portion 80' of the blade actuator 46' depressing the plunger 74.

Turning the primary emphasis now to FIGS. 8 and 11, the safety interlock and method of attachment of the cutter assembly 90 to the plotter 84 will be discussed. To attach the cutting apparatus 90 of the present invention, all that is required is the attachment of a small mounting block 150 to the center of the top surface 88 adjacent the edge 92 as with bolts 152. This requires only the drilling of a pair of holes (not shown) in the top surface 88 of the frame 22. The mounting block 150 has a curved lip 154 along the outer edge thereof. The angled lip 98 contains a slot 156 adapted to fit around the mounting block 150. The bottom edge of the hinged cover 106 also contains an opening 158 in alignment with the slot 156 and having a retaining loop 160 hingedly attached thereto as at 162 and adapted to loop down under the curved lip 154. To attach the cutting apparatus 90 to the plotter 84, the angled lip 98 is simply positioned along the edge 92 with the slot 156 around the mounting block 150 with the hinged cover 106 in its lowered position. The retaining loop 160 is then pivoted under the curved lip 154 and the cover 106 is raised to its closed position wherein the latch 124 is secured. In raising the hinged cover 106, the retaining loop 160 is pulled into the curved lip 154. As can be seen from FIG. 11, the angle of the vertical plate member 96 in relation to the angle lip 98 is such that the pull of the retaining loop 160 between the curved lip 154 and the hinged cover 106 pulls the vertical plate member 96 tightly against the edge 92 of the frame 22. To remove the cutting apparatus 90, the procedure is simply reversed, i.e., the latch 124 is released, allowing the hinged cover 106 to be lowered to its ghosted position of FIG. 11. In so doing, the tension on the retaining loop 160 is released, the loop 160 can be swung out from under the curved lip 154, and the entire cutting apparatus 90 simply lifted off of the frame 22.

Wherefore, having thus described my invention, I claim:

1. In a strip media system wherein a strip media is moved from a supply roller through a work area and onto a takeup roller mounted to a frame, apparatus for longitudinally slitting the strip of media comprising:

(a) a housing adapted to be releasably attached to the frame and including a plate member having a surface in parallel, spaced relationship to the strip media, said surface having an opening therethrough for the passage of a cutting blade;

(b) a cutter assembly retractably mounted to said plate member and having a cutting blade aligned with said opening said cutter assembly being adapted to be moved between an extended position with said blade extending through said opening to contact the strip media to slit it and a retracted position with said blade retracted back through said opening and not being exposed on said surface wherein it is in a safety position protected from being contacted by a system operator;

(c) a latching mechanism having unlocked and locked positions for releasably securing said housing to the frame; and, (d) safety actuator means connected between said latching mechanism and said cutter assembly for moving said cutter assembly to said extended position when said latching mechanism is in said locked position and for moving said cutter assembly to said retracted position when said latching mechanism is in said unlocked position whereby when said apparatus is removed from the system, said blade is automatically moved to said safety position, the improvement wherein:

(e) said housing has a releasably latchable opening portion moveable between open and closed positions;

(f) said cutter assembly is disposed within said housing;

(g) said safety actuator means is connected to said opening portion: and, (h) said latching mechanism is operated by said opening portion whereby when said opening portion is moved to said open position said latching mechanism is in said unlocked position and when said opening portion is moved to said closed position said latching mechanism is in said locked position.

2. The apparatus of claim 1 wherein:

said cutter assembly is adjustably mounted to said plate member for adjustment of its position with respect to the strip media.

3. The apparatus of claim 1 and additionally comprising:

(a) a plurality of said cutter assemblies retractably mounted to said plate member; and wherein, (b) said safety actuator means is selectively connectable to respective ones of said cutter assemblies whereby only selected ones of said blades are moved to said extended position when said latching mechanism is in said locked position.

4. The apparatus of claim 3 wherein:

said cutter assemblies are adjustably mounted to said plate member for adjustment of their position with respect to the strip media.

5. The apparatus of claim 1 wherein:

(a) said housing has a releasably latchable opening portion moveable between open and closed positions;

(b) said cutter assembly is disposed within said housing;

(c) said safety actuator means is connected to said opening portion; and, (d) said latching mechanism is operated by said opening portion whereby when said opening portion is moved to said open position said latching mechanism is in said unlocked position and when said opening portion is moved to said closed position said latching mechanism is in said locked position.

6. Safety paper slitting apparatus for a graphics drum plotter having strip paper moving over an idler roller and onto a takeup roller disposed adjacent a frame portion of the plotter, said apparatus comprising:

(a) a plate member having a surface in parallel, spaced relationship to the strip paper, said surface having an opening therethrough for the passage of a cutting blade, said member having a mounting edge shaped to conform to the frame portion;

(b) a mounting member attached to the frame portion;

(c) a cutter assembly retractably mounted to said plate member and having a cutting blade aligned with said opening, said cutter assembly being adapted to be moved between an extended position with said blade extending through said opening to contact the strip paper to slit it and a retracted position with said blade retracted back through said opening and not being exposed on said surface wherein it is in a safety position protected from being contacted by a system operator;

(d) a latching mechanism having unlocked and locked positions engagable with said mounting member for releasably securing said plate member to the frame portion; and, (e) safety actuator means connected between said latching mechanism and said cutter assembly for moving said cutter assembly to said extended position when said latching mechanism is in said locked position and for moving said cutter assembly to said retracted position when said latching mechanism is in said unlocked position whereby when said apparatus is removed from the system, said blade is automatically moved to said safety position, (f) said plate member having a releasably latchable cover portion moveable between open and closed positions hingedly attached thereto;

(g) said cutter assembly being disposed within said cover portion;

(h) said safety actuator means being connected to said cover portion; and, (i) said latching mechanism being operated by said cover portion whereby when said cover portion is moved to said open position said latching mechanism is in said unlocked position and when said cover portion is moved to said closed position said latching mechanism is in said locked position.

7. The apparatus of claim 6 wherein:

said cutter assembly is adjustably mounted to said plate member for adjustment of its position with respect to the strip paper.

8. The apparatus of claim 7 and additionally comprising:

(a) a plurality of said cutter assemblies retractably mounted to said plate member; and wherein, (b) said safety actuator means is selectively connectable to respective ones of said cutter assemblies whereby only selected ones of said blades are moved to said extended position when said latching mechanism is in said locked position.

9. The apparatus of claim 8 wherein:

said cutter assemblies are adjustably mounted to said wall member for adjustment of their position with respect to the strip paper.

10. The apparatus of claim 6 wherein:

(a) said plate member has a releasably latchable cover portion moveable between open and closed positions hingedly attached thereto;

(b) said cutter assembly is disposed within said cover portion;

(c) said safety actuator means is connected to said cover portion; and, (d) said latching mechanism is operated by said cover portion whereby when said cover portion is moved to said open position said latching mechanism is in said unlocked position and when said cover portion is moved to said closed position said latching mechanism is in said locked position.

* * * * *